US006866188B2

(12) United States Patent
Harrelson

(10) Patent No.: US 6,866,188 B2
(45) Date of Patent: Mar. 15, 2005

(54) PAPERBOARD CARTON WITH TWO NEW TYPES OF DISPENSERS

(75) Inventor: Glen R. Harrelson, Gainesville, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 10/463,958

(22) Filed: Jun. 18, 2003

(65) Prior Publication Data

US 2004/0164133 A1 Aug. 26, 2004

Related U.S. Application Data

(63) Continuation-in-part of application No. 10/371,692, filed on Feb. 22, 2003.

(51) Int. Cl.[7] ..... B65D 5/54; B65D 65/28

(52) U.S. Cl. ..... 229/121; 206/427; 229/122; 229/122.1; 229/160.2; 229/242

(58) Field of Search ..... 229/121, 122, 229/122.1, 160.2, 242, 925; 206/427; 221/305

(56) References Cited

U.S. PATENT DOCUMENTS 3,263,861 A * 8/1966 Carr ..... 229/122.1
3,265,283 A * 8/1966 Farquhar ..... 229/122.1
3,300,115 A * 1/1967 Schauer ..... 221/305
3,332,594 A * 7/1967 De Capua ..... 221/309
3,346,167 A * 10/1967 Schmidt ..... 229/121
3,356,279 A * 12/1967 Root ..... 206/427
3,517,858 A * 6/1970 Farquhar ..... 221/305
4,214,660 A * 7/1980 Hunt, Jr. ..... 206/427
4,396,143 A * 8/1983 Killy ..... 221/305
5,385,234 A * 1/1995 Stout et al. ..... 206/427
5,505,372 A * 4/1996 Edson et al. ..... 229/121
6,478,219 B1 * 11/2002 Holley, Jr. ..... 229/242

* cited by examiner

*Primary Examiner*—Gary E. Elkins
(74) *Attorney, Agent, or Firm*—Womble Carlyle Sandridge & Rice, PLLC

(57) ABSTRACT

A carton for carrying a plurality of cylindrical containers in at least three rows having a dispenser flap that is easily removed from the end of the carton to expose a dispenser which has a bottom of a sufficient height from the bottom panel to prevent containers in the bottom row from rolling out, but less than a diameter of a container in the bottom row. This carton also has a panel dispenser flap that is easily removed from a top or bottom panel of the carton to expose a dispenser which has a bottom of sufficient height from the end of the carton on which it is resting while dispensing containers to prevent the containers in the bottom row from falling out, but less than the diameter of a container in the carton. The top of both the end dispenser and panel dispenser is at a height from the bottom on which the carton is resting while dispensing containers that is equal to the diameter of a container contained in the carton plus the distance that is substantially less than the diameter of a container, such height being sufficient to prevent any container from automatically rolling out of the dispenser when open, but allowing a person to grasp and pull a container from the dispenser.

30 Claims, 3 Drawing Sheets

PAPERBOARD CARTON WITH TWO NEW TYPES OF DISPENSERS

CROSS-REFERENCE TO RELATED APPLICATION

This application is a continuation-in-part of copending U.S. utility application entitled, "Paperboard Carton With A New Type Of Dispenser," having Ser. No. 10/371,692, filed Feb. 22, 2003, pending, which is entirely incorporated herein by reference.

BACKGROUND OF THE INVENTION

1. Field of the Invention

The present invention relates generally to an enclosed paperboard carton capable of enclosing cylindrical containers, such as cans, which carton has two unique opening and dispensing features that allows the consumer to choose the dispenser to open and use. One dispenser is in an end wall that allows the containers, for example cans, to be removed one at a time when the carton is resting on its bottom panel with other containers in the carton falling into position for removal. When this end dispenser is opened when the carton is resting on its bottom panel, the bottom of the end dispenser has been placed far enough above the bottom panel to prevent a container resting on its side in the bottom row from automatically rolling out of the carton. The top of the end dispenser is constructed at a height from the bottom panel sufficient to prevent a can in the second row from automatically rolling out of the carton. The dispenser opening extends into the side panels of the carton to permit a person to grasp each end of the container as it falls into position and remove it from the carton. A finger aperture is provided in the end dispenser flap which is pulled to open the end dispenser with the aperture being located in the space in the side panel formed between the arcs of cans in the first and second row in the dispensing end of the carton.

This carton has a second dispenser that is located in the bottom panel near the end of the carton that does not have an end dispenser. This panel dispenser is designed to dispense containers when the carton is resting on the end panel that does not have a dispenser. The bottom of the panel dispenser has been placed far enough above the non-exiting end of the carton to prevent a container resting on its side adjacent to panel dispenser from automatically rolling out of the carton. The top of the panel dispenser is constructed at a height from the non-exiting end that is sufficient to prevent an adjacent can from automatically rolling out of the carton. The panel dispenser opening extends into the side panels of a carton to permit a person to grasp each end of the container as it falls into position and remove it from the carton. A finger aperture is provided in the panel dispenser flap which is pulled to open the panel dispenser with the aperture being located in the space in the side panel formed between the arcs of the cans adjacent the panel dispenser.

2. Background

Fully enclosed cartons capable of enclosing cans have been used in the past that have a feature for dispensing the cans one at a time. Dispenser sections have been provided at various locations within those cartons depending on the design. Many of these dispensers suffer from the disadvantage that once open, they allow all of the containers to roll out. In addition, it is difficult to carry one of these cartons without the containers falling out once the dispenser has been opened.

Many of these dispensers destroy the overall carton integrity once they have been opened. Many of these dispensing features do not have any means for preventing the first cylindrical container, e.g. can, falling from the carton once the dispenser has been opened. In other words, the dispenser has no safety feature.

SUMMARY OF THE INVENTION

It is an object of this invention to provide a dispenser that preserves the integrity of the carton after the dispenser has been opened. It is a further object to provide a dispenser that can be used with cylindrical containers, such as cans. It is a still further object of this invention to provide a dispenser for dispensing cylindrical containers, such as cans, in a carton where the containers are stacked on their sides in at least three rows and where the containers do not automatically roll out of the carton when it has been opened, but are easily grasped and removed from the carton. It is still a further object of this invention to provide a dispenser flap which has an aperture in which a person's finger can be easily inserted to remove the flap, thus opening the dispenser for the removal of cans. It is still a further object of this invention to provide a carton where the cylindrical containers, such as cans are stacked on their sides in three rows with some of the containers on the top and middle row automatically rolling forward when a can is removed from the dispenser. It is a further object to provide a carton with a dispenser where the cans are stacked on their sides and the cans in the carton do not automatically exist the dispenser, but can be easily removed by grasping the ends of the can.

It is a further object of this invention to develop a dispenser where the cans can be dispensed while the carton is resting on its bottom panel and also dispensed when the carton is resting on an end. In other words, it would be desirable to give the consumer the choice of two dispensers in the carton which are constructed in such a way as not to weaken the carton.

Briefly described, in a preferred form, the objects of this invention are achieved by providing an enclosed carton that has a unique and new dispenser in the exiting end of the carton and a unique and new dispenser in the bottom panel. These dispensers are basically identical, but are located in different places in the carton.

This carton has generally rectangular side panels and has a bottom, a top, and a closed end and an exiting end. This carton is foldably constructed from a blank having panels and flaps. The exiting end of the carton permits cylindrical containers to be taken from the carton through the end dispenser. This carton is designed to carry three or more rows of cylindrical containers, such as cans, resting on their sides on the bottom panel of the carton.

In a preferred form, this carton has ends that are formed by a top end flap, bottom end flap, and two side end flaps which are held together by glue. A tear line is provided in the two side end flaps above the bottom end flap at a height sufficient to prevent any can in the bottom row from automatically rolling out of the end dispenser when it is opened, at least when the bottom panel of the carton is in a horizontal plane. The carton has a top tear line in the two side end flaps that is at a sufficient height from the bottom panel to prevent a can in the second row from automatically rolling out when the end dispenser is opened at least when the bottom panel of the carton is in a horizontal plane.

These top and bottom tear lines extend into a least one of the side panels and turn toward each other and meet each other so that the end dispenser can be opened when removing the end dispenser flap between the top and bottom tear lines. Preferably, the bottom and top tear lines extend into both side panels and turn and meet each other. Preferably, there is a finger aperture between these tear lines in at least one of the side panels that permits a person's finger to enter the aperture and remove the end dispenser flap that opens the end dispenser. Preferably, this finger aperture is placed in the end dispenser flap at the intersection of the side panel and end flap so that a person's finger enters the space between a can in the first row and a can in the second row. This enables a person to obtain the necessary grip and leverage for the easy removal of the end dispenser flap. This aperture can be placed between the bottom and top tear lines in both side panels, preferably at the intersection of a side panel and end flap. Alternatively, this finger aperture can be placed in the dispensing end of the container so that a person's finger enters the space between the can in the bottom row and a can in the second row for easy removal of the end dispenser flap.

The bottom tear line in the dispensing end of the carton is located at a height so that the containers in the bottom row do not automatically roll out when the end dispenser is opened. This height is relative to the diameter of the containers in the bottom row. Preferably, the height of this bottom tear line should be between at least 40 to 80% of the diameter of the containers in the bottom row. It is preferred that the height of the bottom tear line is approximately 60% of the diameter of a can in the bottom row. The location of the top tear line is also related to the diameter of the cans. Preferably, it is basically located at a height from the bottom panel that is approximately the diameter of a can in the bottom row plus a distance that is approximately between 50 and 90% of the diameter of a can in the second row. It is preferred that the height of the top tear line is approximately the diameter of a can in the bottom row plus approximately 80% of the diameter of a can in the second row. Preferably the distance between the bottom tear line and top tear line should be between approximately 110% and 130% of the diameter of a can. It is important that this distance should be great enough so that a can in the second row rolls forward enough so its ends can be grasped for easy removal of the can, but not so great that the cans automatically roll out. The precise location of the bottom and top tear lines is dependent upon the caliber and flexibility of the paperboard of which the carton is constructed and other factors. Basically, the precise location of the bottom and top tear lines within these parameters is located so that when the tear lines are torn cans do not automatically roll out of the carton, at least when the bottom panel of the carton is in a horizontal plane.

It is important that the tear lines that extend into the side panel extend a sufficient distance and height so that a person's fingers can grasp the ends of the can adjacent to the dispenser and remove it easily. Basically, the top and bottom tear lines should extend into each side panel at about the same height from the bottom panel at which they are placed in the end of the carton. These lines need to extend into each side panel a sufficient distance and then turn to meet each other so that when removed it is easy for a person's fingers to grasp the can adjacent to the end dispenser.

It should be realized that the end dispenser flap does not have to be totally removed from the carton as long as it is removed from one side and the end panel. It is preferable that the end dispenser flap be completely removed so that a person's fingers can easily grasp the ends of the can adjacent the dispenser.

This carton also has a panel dispenser that permits cylindrical containers to be taken from the carton through this dispenser. It should be realized that this panel dispenser could be located in the top or bottom panel, but preferably is located in a panel that is not formed from two overlapping flaps for ease of opening. This panel dispenser is preferable formed in the bottom panel adjacent the non-exiting end of the carton. This panel dispenser is designed to allow cylindrical containers to be taken from the carton when the carton is resting on its non-exiting end. This panel dispenser is formed by providing a bottom tear line in the bottom panel above the non-exiting end of the carton at a height sufficient to prevent any can adjacent to the non-exiting end of the carton from automatically rolling out of the panel dispenser when it is open when the non-exiting end of the carton is in a horizontal plane. The carton has a top tear line in the bottom panel that is at a sufficient height from the non-exiting end of the carton to prevent a can adjacent to the panel dispenser from automatically rolling out when the panel dispenser is opened and the non-exiting end of the carton is in a horizontal plane.

These top and bottom tear lines of the panel dispenser extend into at least one of the side panels and turn towards each other and meet so that the panel dispenser can be opened enough when removing the panel dispenser flap between the top and bottom tear lines. Preferably, the bottom and top tear lines extend into both side panels and turn and meet each other. Preferably, there is a finger aperture between these tear lines in at least one of the side panels that permits a person's finger to enter the aperture and remove the panel dispenser flap that opens the panel dispenser. Preferably, this finger aperture is placed in the panel dispenser flap at the intersection of the side panel and bottom panel so that a person's finger enters the space between cans adjacent to the dispenser flap. This enables a person to obtain the necessary grip and leverage for the easy removal of the panel dispenser flap. This aperture can be placed between the bottom and top tear lines in both side panels, preferably at the intersection of a side panel and bottom panel. Alternatively, this finger aperture can be placed in the bottom panel in the panel dispenser flap so that a person's finger enters the space between two cans adjacent the bottom panel.

The bottom tear line in the panel dispensing flap is located at a height from the adjacent end of the carton so that containers that are immediately next to the adjacent end of the carton do not automatically roll out when the panel dispenser is opened. The height is relative to the diameter of the containers immediately next to the adjacent end of the carton. As in the case of the end dispenser, preferably the height of the bottom tear line should be between at least 40 to 80% of the diameter of the containers. It is preferred that the height of the bottom tear line is approximately 60% of the diameter of the containers. It is preferred that the top tear line of the panel dispenser is basically located at a height from the adjacent end of the carton that is approximately the diameter of a can plus a distance that is approximately between 50 and 90% of the diameter of a can. Preferably, the height of the top tear line is approximately the diameter of a can plus 80% of the diameter of a can. Preferably, the distance between the bottom tear line and the top tear line should be between approximately 110 and 130% of the diameter of a can. It is important that this distance should be great enough so that a can rolls forward when the dispenser is opened so its ends can be grasped for easy removal of the can, but not so great that the can automatically rolls out. The precise location of the bottom and top tear lines is dependent upon the caliber and flexibility of the paperboard of which the carton is constructed and other factors.

It is important that the tear lines for the panel dispenser extend into the side panel a sufficient distance and height so that a person's fingers can grasp the ends of the can adjacent to the dispenser and remove it easily. Basically, the top and bottom tear lines of the panel dispenser should extend into each side panel at about the same height from the adjacent end of the carton at which they are placed in the bottom panel of the carton. These lines need to extend into each side panel a sufficient distance and then turn to meet each other so that when removed it is easy for a person's fingers to grasp the can adjacent to the panel dispenser.

It should be realized that the panel dispenser flap does not have to be totally removed from the carton as long as it is removed from one side and the end panel. It is preferable that the panel dispenser flap be completely removed so that a person's fingers can easily grasp the ends of the can adjacent the dispenser.

This carton can be constructed by gluing, taping, stapling and the like, or by locking. It is preferred that this carton be glued. The dispenser of this invention can be put in one end of the carton or in both ends. These and other objects, features, and advantages of he present invention will become more apparent upon reading the following specification in conjunction with the accompanying drawing figures.

DETAILED DESCRIPTION OF THE PREFERRED EMBODIMENT

Figure 1:
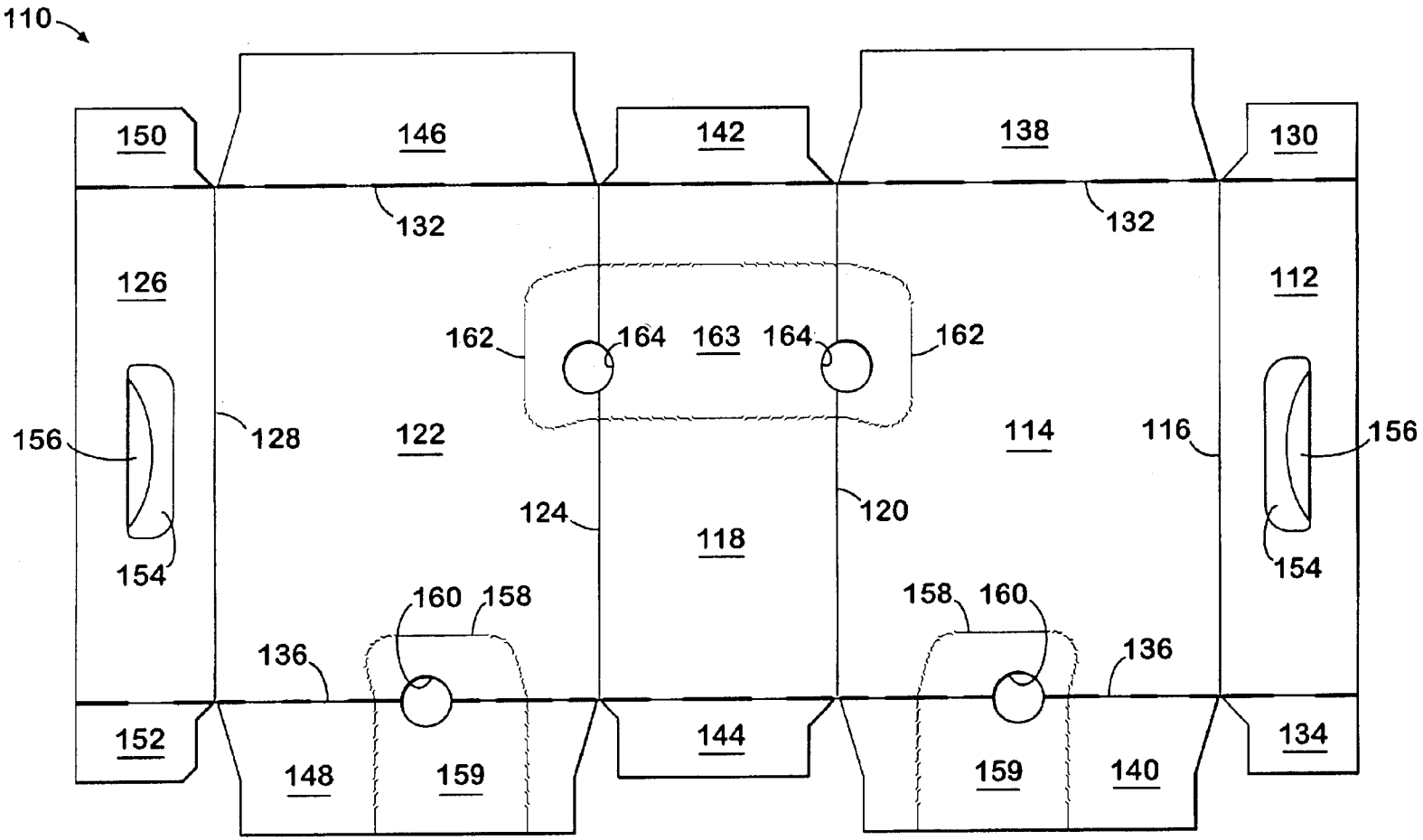
FIG. 1 is a plan view of a blank from which a carton according to one embodiment of this invention is formed.

The present invention is intended primarily for use with cans of the type used to contain soft drinks, beer and the like. The blank 110 is formed from a foldable sheet of material, such as paperboard. The blank has a handle flap 112 which is foldably connected to side panel 114 by fold line 116, and in turn connected to bottom panel 118 by fold line 120. Bottom panel 118 is foldably connected to side panel 122 by fold line 124 and in turn connected to handle flap 126 by fold line 128. Handle flap 112 is foldably connected to top end flap 130 by fold line 132 and connected to top end flap 134 by fold line 136. Side panel 114 is foldably connected to side end flap 138 by fold line 132 and foldably connected to side end flap 140 by fold line 136. Bottom panel 118 is foldably connected to bottom end flap 142 by fold line 132 and foldably connected to bottom end flap 144 by fold line 136. Side panel 122 is foldably connected to side end flap 146 by fold line 132 and side end flap 148 is foldably connected to side panel 122 by fold line 136. Handle flap 126 is foldably connected to top end flap 150 by fold line 132 and to top end flap 152 by fold line 136.

The carton made from this blank 110 may have a handle. This carton is provided with a racetrack handle 154 formed in handle flaps 112 and 126. It may be provided with a cushioning flap 156 to cushion a person's hand when carrying the carton.

The carton formed from blank 110 has an end dispenser flap 159 that is formed by tear line 158 in side panel 114 and which extends into side end flap 140. A tear line 158 extends from side panel 122 into side end flap 148. This dispenser flap 159 may be provided with one or more finger apertures 160 for the easy removal of the end dispenser flap 159.

Figure 3:
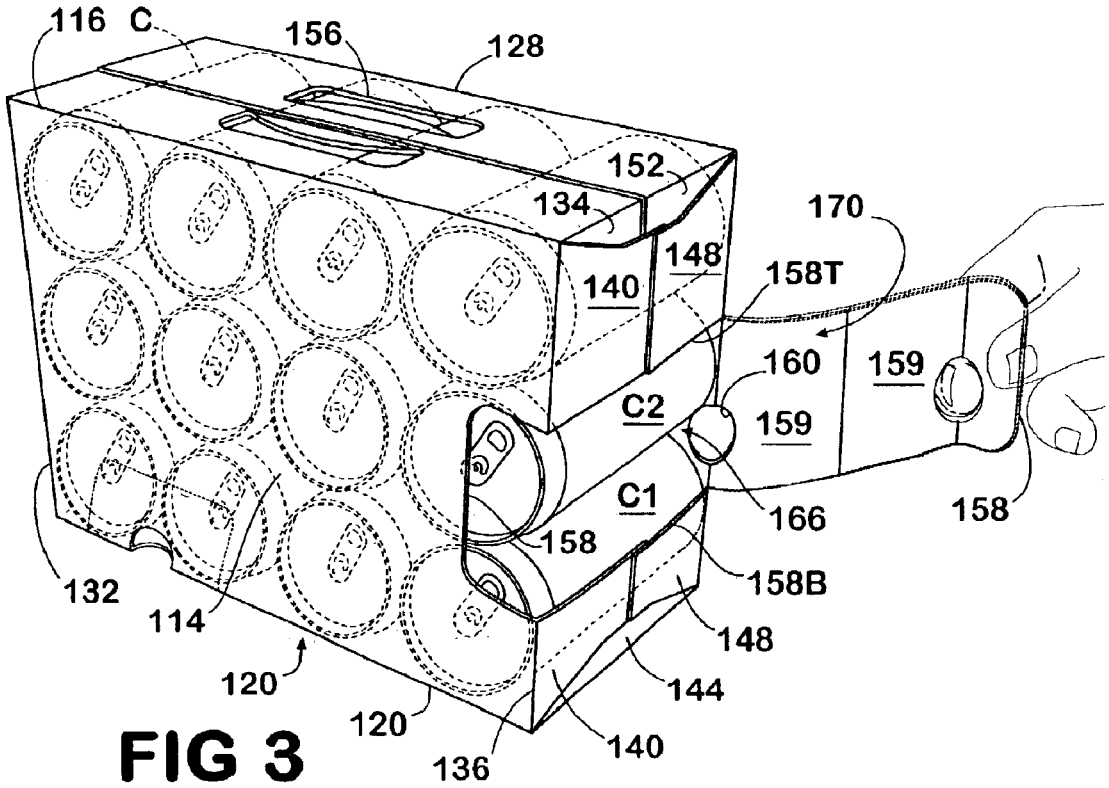
FIG. 3 is a perspective end view of the carton containing cans in which a person's finger has been inserted into the finger aperture in a side panel partially pulling the end dispenser flap away from the carton except in one side panel. The carton in FIG. 3 is shown in the preferred position for dispensing cans from the end dispenser.

These finger apertures 160 should be located in a position so that a person's finger may be inserted into the finger aperture 160 in the space formed between the arc of a can in the bottom row and the arc of a can in the next row which are in contact with the end dispenser flap 159. This allows a person's finger to be inserted far enough into the carton to provide the necessary leverage for removing the end dispenser flap 159. Preferably, a finger aperture 160 is placed on each side of the end dispenser flap 159 to provide the necessary leverage for the removal of the flap. It is preferred that the finger apertures be centered on fold line 136 which is the ideal location for the insertion of a person's finger into the space between a can C1 in the bottom row and a can C2 in the second row and the end dispenser flap 159 as shown in FIG. 3.

Figure 4:
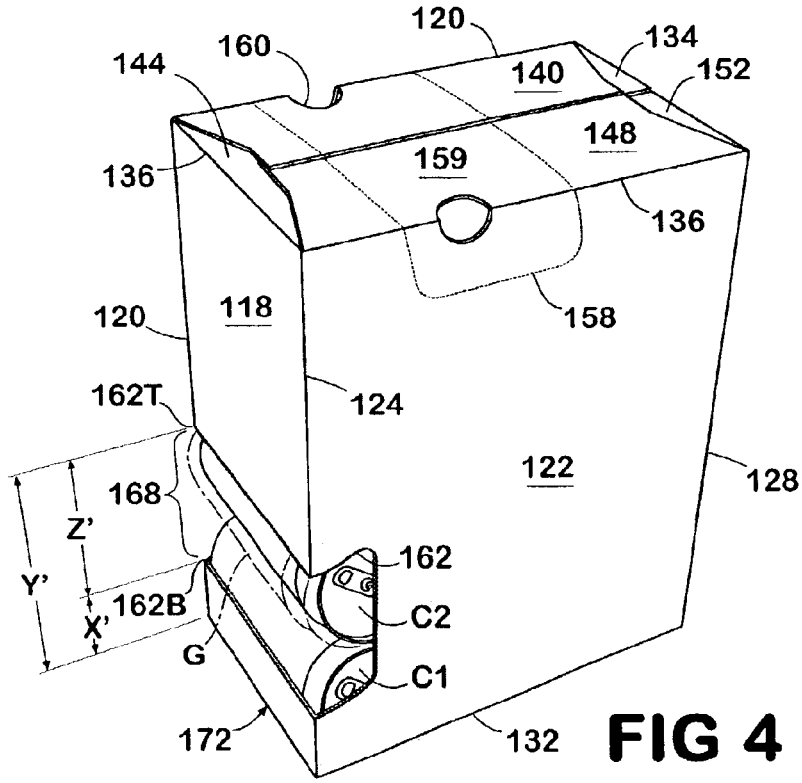
FIG. 4 is a perspective side view of a carton according to an embodiment of this invention in which both the end dispenser and panel dispenser are opened when the carton resting on its non-dispensing end. The panel dispenser is shown in FIG. 4 in preferred position for dispensing cans from the panel dispenser.

The carton formed from this blank is provided with an additional dispenser so the consumer can decide which dispenser to open, which will largely be governed by how the loaded carton is placed on a shelf or table for unloading. Panel dispenser flap 163 is formed by tear line 162 which extends from side panel 114 through bottom panel 118 and into side panel 122. One or more finger apertures 164 may be provided for the easy removal of panel dispenser flap 163. These finger apertures 164 should be located in a position so that a person's finger may be inserted into the finger aperture in the space formed between the two arcs formed by adjacent cans C1 and C2 in that portion of panel dispenser flap 163 that extends into side panel 122 and that portion of the panel dispenser flap 163 that extends into side panel 114 as shown in FIG. 4. This allows a person's finger to be inserted far enough into the carton to provide the necessary leverage for removing the panel dispenser flap 163. As in the case of the end dispenser flap 159, the finger apertures 164 are placed on each side of the panel dispenser flap 163 to provide the necessary leverage for removal of the flap. It is preferred that the finger apertures 164 be centered on fold lines 120 and 124 which is the ideal location for the insertion of a person's finger into the space between the ends of the cans adjacent the portions of the dispenser flap 163 in side panel 114 and side panel 122.

The carton of this invention is easily formed and loaded with cans in the conventional fashion. The blank is folded along fold line 116, 120, 124 and 128. Handle flaps 112 and 126 are glued together forming a sleeve into which the cans are loaded with the sides of the can resting on bottom panel 118. Using the end of the carton where end dispenser 159 is located, top end flaps 134 and 152 are folded down and bottom end flap 144 is folded up and side end flaps 140 and 148 are folded over the end and glued to bottom end flap 144 and top end flaps 134 and 152. The other end of the carton is closed in the same way.

Figure 5:
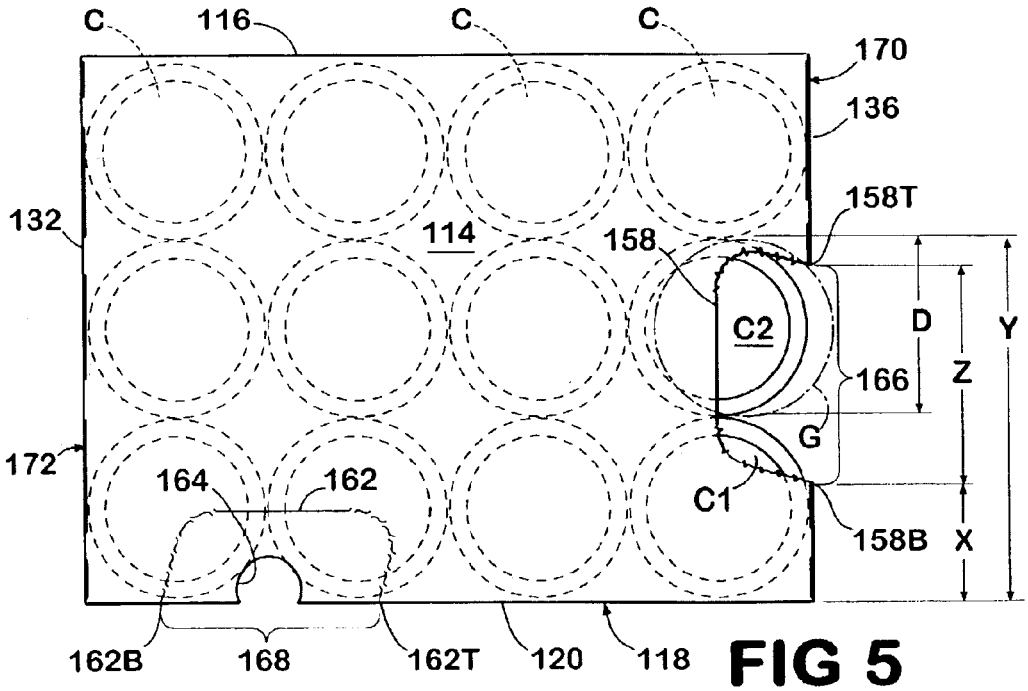
FIG. 5 is a side view of the carton showing the location of the cans. The carton is shown in the preferred position for dispensing cans from the end dispenser.

As illustrated in FIG. 5 this carton is designed to carry 12 cans in a 3 by 4 configuration. It should be realized that a carton can be designed to carry more than three rows and more than four cans in each row as illustrated in FIGS. 3 and 5. The portion of the tear line 158B in the exiting end 170 near the bottom of the carton needs to be a sufficient distance from the bottom panel 118 so that a can C1 in the bottom row does not roll out of the carton when the end dispenser flap 159 is opened. The top portion of tear line 158T needs to be located from the bottom panel 118 at a distance equal to the diameter of a can (e.g. C1) in the bottom row plus a distance that is substantially less than the diameter a can (e.g. C2) of the container in the middle row but sufficient to prevent any can in the middle row from automatically rolling out of the dispenser when the bottom panel 118 of the carton is in a horizontal plane. Preferably, the bottom tear line 158B needs to be at a height that is between approximately 40% to 80% of the diameter of a container, as measured from the bottom panel 118. It is preferred that the height of the bottom tear line 158B is approximately 60% of the diameter of a can (e.g. C1) contained in the bottom row, as measured from the bottom panel 118.

Preferably, the top tear line 158T should be located from the bottom panel 118 a distance equal to the diameter of the container in the bottom row plus approximately between 50 and 90% of the diameter of a container in the middle row. It is preferred that the top tear line 158T is located at a distance equal to the diameter of a can in the bottom row plus approximately 80% of the diameter of a can in the second row, as measured from the bottom panel 118.

Figure 2:
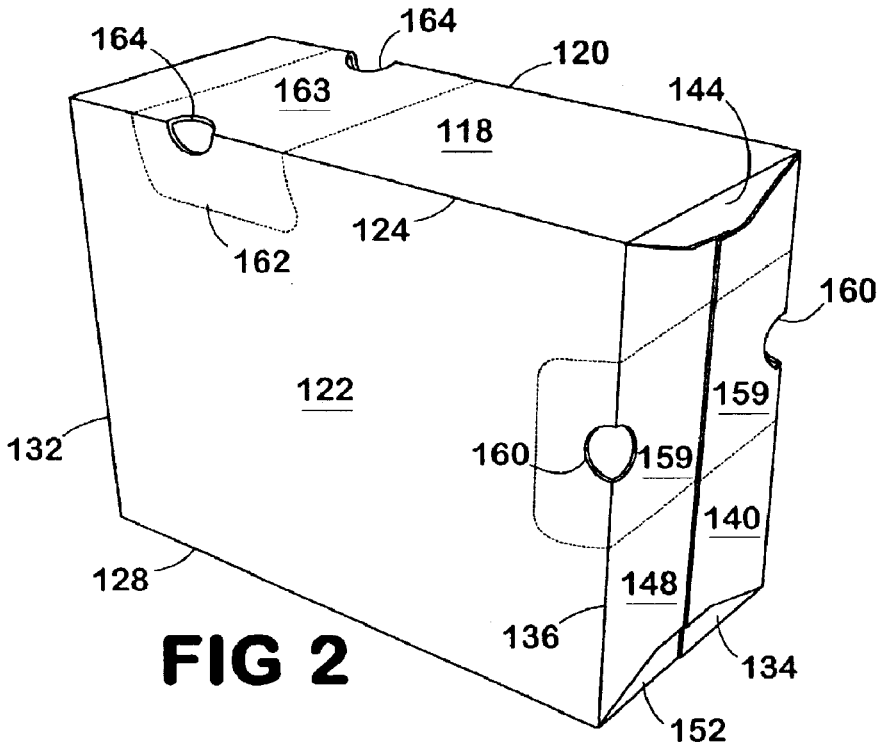
FIG. 2 is a perspective view of a carton loaded with cans showing the location of the end dispenser and the panel dispenser in the bottom panel. The carton is shown with the top panel with the handle on the bottom of the figure.

FIG. 2 illustrates the carton formed from the blank of FIG. 1 that is filled with cans. This carton is resting on the top panel with the handle in order to show the end dispenser flap 159 and panel dispenser flap 163.

It is preferred that the ends of the carton be constructed of flaps that are glued together to form the end panels. While in the carton of this embodiment as described in FIG. 1 the end flaps are closed and glued to form the exiting end, it should be constructed from the same carton blank but the folding and gluing or securing that is necessary is done elsewhere on the blank. End dispenser flap 159 is designed to be utilized when the carton is resting on its bottom panel 118.

A panel dispenser flap 163 is provided in bottom panel 118 as illustrated in FIG. 2. As illustrated in FIG. 4, the portion of the tear line 162B near the non-exiting end 172 of the carton needs to be a sufficient distance from the non-exiting end so that a can C1 adjacent the panel dispenser 168 and the non-exiting end 172 does not roll out of the carton when the panel dispenser 168 is open. The top portion 162T of the tear line needs to be located from the non-exiting end 172 at a distance equal to the diameter of a can plus a distance that is substantially less than the diameter of a can, but sufficient to prevent the can C2 above the can C1 which is adjacent to the non-exiting end 172 and the panel dispenser 168 from automatically rolling out when the carton is resting on its non-exiting end 172 as shown in FIG. 4. Preferably, the bottom tear line 162B is located at a height that is between approximately 40 to 80% of the diameter of a container as measured from the non-exiting end 172. Preferably, the height of the bottom tear line 162B is approximately 60% of the diameter of a can as measured from the non-exiting end 172. It is preferred that the top tear line 162T is located from the non-exiting end 172 a distance that is equal to the diameter of a container plus approximately between 50 and 90% of the diameter of a container. It is preferred that the top tear line 162T is located at a distance equal to the diameter of a can plus approximately 80% of the diameter of a can as measured from the non-exiting end 172.

For purpose of assuring the structural integrity of a carton having both an end dispenser 166 and a panel dispenser 168, it is preferred that the panel dispenser be constructed adjacent the non-exiting end 172 of the carton. It is preferred that the panel dispenser 168 be constructed from a panel that is not formed by overlapping flaps. In the carton constructed from the blank illustrated in FIG. 1 the top of the carton is constructed from overlapping handle flaps 112 and 126. The panel dispenser 168 can be constructed from the bottom panel or the top panel, but it is preferable that it be constructed from a panel that is not composed of overlapping flaps.

Opening the end dispenser 166 is illustrated in FIG. 3, where a person's finger has been inserted through finger aperture 160 in end dispenser flap 159, exposes the cans C1 and C2 in the bottom two rows. A top row of cans is shown in FIG. 3. After end dispenser flap 159 has been removed, the person's finger and thumb can grasp the ends of cans C2 for removal of the can. It will be noticed from FIG. 5 that can C2 in the second row moves slightly forward past the end of the carton to a position represented by G showing the outside arc of the can C2. The placing of bottom tear line 158B and top tear line 158T is important so that can C2 in the second row rolls forward to position G as shown in FIG. 5 so the ends of the cans C2 can be grasped for easy removal. The top tear line 158T cannot be placed too high or the cans will automatically roll out of the carton. After can C2 is removed a can in the top row will drop down for the next removal from the dispenser. Some subsequent cans will roll into position when cans are removed from the end dispenser 166. The carton can be tilted forward so other cans come forward for removal. As previously described the location of the bottom tear line and of the top tear line are at sufficient heights to retain all the cans in the carton when the end dispenser 166 is open but with sufficient distance between them to permit the easy removal of the cans. A can can only be easily removed if it can be grasped on both ends.

As an example of the placement of the top 158T and bottom 158B tear lines, FIG. 5 can be used to show the principles. With a can C that has a diameter D of 2.6 inches, the height X of the bottom tear line 158B is preferably placed at approximately 1.6 inches from the bottom of the carton, while the top tear line 158T is placed at a height Y from the bottom panel 118 of approximately 4.65 inches. This results in an end dispenser 166 opening Z of 3.05 inches. The preferred placement of the bottom 158B and top 158T tear lines will depend upon a number of factors, such as the caliber and other characteristics of the paperboard. The bottom tear line 158B needs to be placed at a height so the cans in the bottom row do not roll out, but not so high that a can in the bottom row cannot be grasped and easily removed when the cans in the upper rows have been removed. The top tear line 158T needs to be placed so that it retrains the cans in the upper rows from automatically rolling out of the carton. It also should be placed so that a can C can be grasped on the ends for easy removal, which means the can C2 in the second row near the end dispenser 166 must roll forward slightly to the position indicated by phantom line G as explained above. The placement of tear line 158 in side panels 114 and 122 facilitates the grasping of the ends of the cans.

It is preferable that the finger aperture 160 be placed in each side panel 114 and 122 near the fold line 136. It is preferable that the finger aperture 160 be centered on fold line 136. The finger aperture 160 can be placed in end dispenser flap 159 in side end flap 140 or side end flap 148 so that a person's finger enters the space between can C1 in the bottom row and a can C2 in the middle row as shown in FIG. 5.

These same principles apply to the placement of bottom tear line 162B and top line 162T in panel dispenser 168 in bottom panel 118. Panel dispenser 168 is designed to operate when the carton is place on its non-exiting end 172 as illustrated in FIG. 4. The height X' of the bottom tear line 162B is preferably placed at 1.6 inches from the non-exiting end 172 of the carton, while the top tear line 162T is placed at a height Y' from the non-exiting end 172 of the carton of approximately 4.65 inches. This results in a panel dispenser 168 opening Z' of 3.05 inches. The bottom tear line 162B needs to be placed at height so that a can C1' that is now in the bottom row as the carton is placed on its non-exiting end 172 as illustrated in FIG. 4, does not roll out, but not so high that a can (e.g. C1') in the bottom row cannot be grasped and easily removed when the cans above it have been removed. The top tear line 162T needs to be placed so that it retains the cans in the upper rows from automatically rolling out of the carton. The top tear line 162T should also be placed so that a can C can be grasped by its ends for easy removal, which means that can C2' in what is now the second row near the panel dispenser 168 must roll forward slightly to the position indicated by phantom line G as explained above. The placement of the tear line 162 in the side panels 114 and 122 facilitates grasping the ends of the cans.

It is preferable that the finger apertures 164 be placed in each side panel 114 and 122 near the fold lines 120 and 124. It is preferable that the finger aperture 164 be centered on fold lines 120 and 124 so the panel dispenser flap 163 can be removed from either side. This placement allows a person's finger to enter the space between cans adjacent to panel dispenser flap 163.

It is preferable that the panel dispenser 168 be placed in a bottom panel 118 near the non-exiting end 172 of the carton. Handles other than the handles illustrated in FIG. 1 can be used with a carton of this invention or it can be made with no handle at all.

The end and panel dispensers of this invention can be used for both cans and other types of cylindrical containers.

Unique Features of the Dispensers of this Invention

One of the unique features of the end dispenser and panel dispenser of this invention is that they provide for easy removal of the dispenser flap giving easy access to the cans, but do not diminish the structural integrity of the carton. Having a dispenser in the end of the carton, and also in the bottom panel of the carton gives a person two choices for placing the carton for dispensing cans. The panel dispenser and end dispenser are easy to open because of the placement of the finger apertures. Each dispenser is designed so that the bottom tear line when the dispenser is opened retains cans in the bottom row and the top tear line is located at a sufficient height so that it retains cans above the bottom row, but also permits easy removal of the can above the bottom row which is partially achieved by the placement of the top tear line and by the extension of the tear lines into the side panel to permit a person to grasp the ends of the can for removal.

While the invention has been disclosed in its preferred forms, it will be apparent to those skilled in the art that many modifications, additions, and deletions can be made therein without departing from the spirit and scope of the invention and its equivalents as set forth in the following claims.

Therefore, having thus described the invention, at least the following is claimed:

1. An enclosed carton for carrying a plurality of cylindrical containers in at least three rows, with a bottom row, a middle row and a top row, with each container having a common diameter and two ends, the carton having ends, one end of the carton being a non-exiting end and another end being an exiting end capable of permitting the containers to exit the carton one at a time, the carton comprising:

(a) bottom panel;

(b) a top panel, wherein one of the bottom and top panel is an exiting panel capable of permitting the containers to exit the carton one at a time (c) foldably attached adjoining side panels; and (d) means for closing the carton, wherein said exiting end has an exiting bottom tear line and exiting end top tear line which are at least approximately parallel to each other for forming an end dispenser that is opened by tearing the exiting end at the exiting end tear lines, said exiting end bottom tear line having a height from said bottom panel that is less than the diameter, but a sufficient height to prevent any of the containers in the bottom row from automatically rolling out when said end dispenser is open when the carton is resting on said bottom panel, said exiting end top tear line has a height from said bottom panel that is equal to the diameter plus a distance that is substantially less than the diameter, but at a sufficient height from said bottom panel to prevent any container in the middle row from automatically rolling out of said end dispenser when the end dispenser is open and when the carton is resting on maid bottom panel, said exiting end top and bottom tear lines extend into at least one of said side panels a sufficient distance and turning towards each other a sufficient distance to permit said exiting end top and bottom tear lines to be torn open so that at least one of the ends of the containers in the middle row adjacent said exiting end can be grasped and removed from the carton, said exiting panel has an exiting panel bottom and an exiting panel top tear line which are at least approximately parallel to each other for forming a panel dispenser, said exiting panel bottom tear line having a height from an adjacent end of the carton that as less than the diameter, but at a sufficient height to prevent any of the containers from automatically rolling out when said panel dispenser is open and when the carton is resting on the adjacent end of the carton, said exiting panel top tear line has a height from said adjacent end that is equal to the diameter plus a distance that is substantially less than the diameter, but at a sufficient height from said adjacent end to prevent any of the containers from rolling out of said panel dispenser when the panel dispenser is open and when the carton is resting on said adjacent end, and said exiting panel top and bottom tear lines extend into at least one of said side panels a sufficient distance and turning towards each other a sufficient distance to permit said exiting panel top and bottom tear lines to be torn open so that at least one of the ends of one of the containers adjacent to said panel dispenser can be grasped and removed from the carton.

2. The carton of claim 1, in which said panel dispenser is located adjacent to the non-exiting end of the carton.

3. The carton of claim 1, which has a non-exiting panel formed from two overlapping flaps.

4. The carton of claim 1, comprising:

at least one finger aperture located between the exiting end top and bottom tear lines; and at least one finger aperture located between the exiting panel top and bottom tear lines.

5. The carton of claim 1, in which said exiting end bottom and top tear lines and said exiting panel bottom and top tear lines extend into each side panel a sufficient distance and turn toward each other a sufficient distance to permit said exiting panel and said exiting end top and bottom tear lines to be torn open so that the ends of one of the containers can be grasped and removed from the carton.

6. The carton of claim 5, in which there is at least one finger aperture located between said exiting end top and bottom tear lines and at least one finger aperture located between said exiting panel top and bottom tear lines, each said finger aperture being of sufficient size and configuration to permit a person's finger to enter each said aperture.

7. The carton of claim 1, in which at least one of the dispensers has a finger aperture located between its top and bottom tear lines of a sufficient size and configuration to permit a person's finger to enter said aperture and tear said respective dispenser open, said finger aperture being located so that a person's finger enters the carton between the space formed between points at which two of the containers adjacent to the respective dispenser contact each other and the dispenser.

8. The carton of claim 1, in which the exiting end bottom tear line is located from the bottom panel at a height that is between approximately 40% to approximately 80% of the diameter, and in which the exiting panel bottom tear line is located from the adjacent end of the carton at a height that is approximately 40% to 80% of the diameter.

9. The carton of claim 1, in which the exiting end top tear line is located from the bottom panel at a height that is the diameter plus a distance between approximately 50 and 90% of the diameter, and the exiting panel top tear line is located from the adjacent end at a height that is the diameter plus a distance between approximately 50 and 90% of the diameter.

10. The carton of claim 8, in which the exiting end top tear line is located from the bottom panel at a height that is the diameter plus a distance between approximately 50 and 90% of the diameter, and the exiting panel top tear line is located from the adjacent end at a height that is the diameter plus a distance between approximately 50 and 90% of the diameter.

11. The carton of claim 1, in which the exiting end bottom tear line is located from the bottom panel at a height that is approximately 60% of the diameter and the exiting panel bottom tear line is located from the adjacent end of the carton at a height that is approximately 60% of the diameter.

12. The carton of claim 11, in which the exiting top tear line is located from the bottom panel at a height that is the diameter plus the distance that is approximately 80% of the diameter, and the exiting panel top tear line is located from the adjacent end of the carton at a height that is the diameter plus the distance that is approximately 80% of the diameter.

13. The carton of claim 2, in which the exiting end bottom tear line is located from the bottom panel at a height that is between approximately 40 to approximately 80% of the diameter, and the exiting panel bottom tear line is located from the adjacent end of the carton at a height that is between approximately 40 to approximately 80% of the diameter.

14. The carton of claim 2, in which the exiting end top tear line is located from the bottom panel at a height that is the diameter plus a distance between approximately 50 and 90% of the diameter, and the exiting panel top tear line is located from the adjacent end of the carton at a height that is the diameter plus a distance between approximately 50 and 90% of the diameter.

15. The carton of claim 14, in which the exiting end bottom tear line is located from the bottom panel at a height that is approximately 40 to approximately 80% of the diameter, and the exiting panel bottom tear line is located from the adjacent end of the carton at a height that is between approximately 40 to approximately 80% of the diameter.

16. An enclosed carton for carrying a plurality of cylindrical containers in at least three rows, with a bottom row, a middle row and a top row, with each container having a common diameter and two ends, the carton having ends, one end of the carton being a non-exiting end and another end being an exiting end capable of permitting containers to exit the carton one at a time, the carton comprising:

a bottom panel;

a top panel, wherein one of the bottom and top panel is an exiting panel capable of permitting the containers to exit the carton one at a time when pulled from said exiting panel;

foldably attached adjoining side panels; and means for closing the carton, wherein said exiting end has a bottom end flap with a height that is significantly less than the diameter and which is attached by a fold line to the bottom panel, a top end flap foldably attached to the top panel, a side end flap foldably attached to each side panel and means for attaching said flaps together to close the exiting end of carton, said exiting end has an exiting end bottom tear line and an exiting end top tear line which are at least approximately parallel to each other, for forming an end dispenser, said exiting end bottom tear line having a height from said bottom panel that is less than the diameter, but a sufficient height to prevent any of the containers in the bottom row from automatically rolling out when said end dispenser is open and when the carton is resting on said bottom panel, said exiting end top tear line has a height from said bottom panel that is equal to the diameter plus a distance that is substantially less than the diameter, but at a sufficient height from said bottom panel to prevent any of the containers in the middle row from automatically rolling out of said end dispenser is open and when the carton is resting on said bottom panel, said exiting end top and bottom tear lines extend into at least one of said side panels a sufficient distance and turning towards each other a sufficient distance to permit said exiting end top and bottom tear lines to be torn open so that at least the ends of the containers in the middle row adjacent to said exiting end can be grasped and removed from the carton, said exiting panel has an exiting panel bottom and an exiting panel top tear line which are at least approximately parallel to each other for forming a panel dispenser, said exiting panel bottom tear line having a height from an adjacent end of the carton that is less than the diameter, but a sufficient height to prevent any of the containers next to said adjacent end of the carton from automatically rolling out when said panel dispenser is open and when the carton as resting on the adjacent end of the carton, said exiting panel top tear line has a height from said adjacent end that is equal to the diameter plus a distance that is substantially less than the diameter, but at a sufficient height from said adjacent end to prevent any of the containers adjacent to said panel dispenser from rolling out of said panel dispenser when the dispenser is open and when the carton is resting on said adjacent end, and said exiting panel top and bottom tear lines extend into at least one of said side panels a sufficient distance and turning towards each other a sufficient distance to permit said exiting panel top and bottom tear lines to be torn open so, that the ends of any of the containers adjacent to said panel dispenser can be grasped and removed from the carton.

17. The carton of claim 16, in which said exiting end bottom and top tear lines extend into each side panel a sufficient distance and turn towards each other a sufficient distance to permit said exiting end top and bottom tear lines to be torn open so that the ends of one of the containers contained in the middle row can be grasped and removed from the carton, and said exiting panel bottom and said top tear lines extend into each side panel a sufficient distance and turn towards each other a sufficient distance to permit said exiting panel top and bottom tear lines to be torn open so that the ends of one of the containers adjacent to said panel dispenser can be grasped and removed from the carton.

18. The carton of claim 17, in which the exiting end bottom tear line is located from the bottom panel at a height that is approximately 40 to approximately 80% of the diameter, and in which said exiting panel bottom tear line is located from the adjacent end of the carton at a height that is between approximately 40 to approximately 80% of the diameter.

19. The carton of claim 18, in which the exiting end top tear line is located from the bottom panel at a height that is the diameter plus the distance between approximately 50 and 90% of the diameter, and said exiting panel top tear line is located from the adjacent end of the carton at a height that is the diameter plus the distance between approximately 50 and 90% of the diameter.

20. The carton of claim 18, in which the exiting end top tear line is located from the bottom panel at a height that is the diameter plus a distance that is approximately 80% of the diameter, and said exiting panel top tear line is located from the adjacent end of the carton at a height that is the diameter plus a distance that is approximately 80% of the diameter.

21. The carton of claim 16, in which the distance between the exiting end bottom tear line and the exiting end top tear line is between 110 and 130% of the diameter, and the distance between said exiting panel bottom tear line and said exiting panel top tear line is between 110 and 130% of the diameter.

22. An enclosed carton for carrying a plurality of cylindrical containers in three rows, with a bottom row, middle row and top row, with each container having a common diameter and two ends, the carton having ends, one end of the carton being an exiting end capable of permitting containers to exit the carton one at a time when a container is pulled from said exiting end, the carton comprising:

a bottom panel;

a top panel, wherein one of the bottom and top panel is an exiting panel capable of permitting the containers to exit the carton one at a time;

foldably attached adjoining side panels; and means for closing the carton, wherein said exiting end has a bottom end flap with a height that is significantly less than the diameter and which is attached by a fold line to the bottom panel, a top end flap foldably attached to the top panel, a side end flap foldably attached to the top panel, a side end flap foldably attached to each side panel and means for attaching said flaps together to close the exiting end of the carton said exiting end has an exiting end bottom tear line and an exiting end top tear line which are at least approximately parallel to each other, for forming an end dispenser, said exiting end bottom tear line having a height from said bottom panel that is less than the diameter, but at a sufficient height to prevent any of the containers in the bottom row from automatically rolling out when said end dispenser is open when the carton is resting on said bottom panel, said exiting end top tear line has a height from said bottom panel that is equal to the diameter plus a distance that is substantially less than the diameter, but at a sufficient height from said bottom panel to prevent any of the containers in the middle row from automatically rolling out of said end dispenser when said end dispenser open and when the carton is resting on said bottom panel, said exiting end top and bottom tear lines extend into at least one of said side panels a sufficient distance and turning towards each other a sufficient distance to permit said exiting end top and bottom tear lines to be torn open so that at least one of the ends of the containers in the middle row adjacent to said exiting end can be grasped and removed from the carton, said exiting panel has an exiting panel a bottom tear line and an exiting panel top tear line which are at least approximately parallel to each other for forming a panel dispenser, said exiting panel bottom tear line having a height from an adjacent end of the carton that is less than the diameter, but a sufficient height to prevent any of the containers adjacent to said adjacent end of the carton from automatically rolling out when said panel dispenser is open when the carton is resting on said adjacent end of the carton, said exiting panel top tear line has a height from said adjacent end that is equal to the diameter plus a distance that is substantially less than the diameter, but at a sufficient height from said adjacent end to prevent any of the containers adjacent to said panel dispenser from rolling out of said panel dispenser when the panel dispenser is open and when the carton is resting on said adjacent end, and said exiting panel top and bottom tear lines extend into at least one of said side panels a sufficient distance and turning towards each other a sufficient distance to permit said exiting panel top and bottom tear lines to be torn open so that the end of any of the containers adjacent to said panel dispenser can be grasped and removed from the carton.

23. The carton of claim 22, in which said exiting end bottom and top tear lines extend into each side panel a sufficient distance and turn towards each other a sufficient distance to permit said exiting end top and bottom tear lines to be torn open so that the ends of any of the containers contained in the middle row adjacent to said exiting end can be grasped and removed from the carton, and in which said exiting panel bottom and said top tear lines extend into each side panel a sufficient distance and turn towards each other a sufficient distance to permit said exiting panel top and bottom tear lines to be torn open so that the ends of any of the containers adjacent to said panel dispenser can be grasped and removed from the carton.

24. The carton of claim 22, in which a finger aperture for opening said end dispenser is located at least partially in at least one of said side panels.

25. The carton of claim 23, in which said exiting end bottom tear line is located from the bottom panel at a height that is between approximately 40 to approximately 80% of the diameter, and in which said exiting panel bottom tear line is located from said adjacent end of the carton at a height that is between approximately 40 to approximately 80% of the diameter.

26. The carton of claim 25, in which the said exiting end top tear line is located from the bottom panel at a height that is the diameter plus a distance between approximately 50 and 90% of the diameter, and in which said exiting panel top tear line is located from said adjacent end of the carton at a height that is the diameter plus the distance between 60 and 90% of the diameter.

27. The carton of claim 23, in which said exiting end bottom tear line is located from said bottom panel at a height that is approximately 60% of the diameter, and in which said exiting panel bottom tear line is located from said adjacent end of the carton at a height that is approximately 60% of the diameter.

28. The carton of claim 27, in which said exiting end top tear line is located from the bottom panel at a height that is the diameter plus a distance between approximately 80% of the diameter, and in which said exiting panel top tear line is located from said adjacent end of the carton at height that is the diameter plus a distance that is approximately 80% of the diameter.

29. The carton of claim 23, in which the distance between said exiting end bottom tear line to said exiting end top tear line and the distance between said exiting panel bottom tear line to the exiting panel top tear line is between 110 and 130% of the diameter.

30. The carton of claim 23, in which said exiting end bottom tear line is approximately the height of said bottom end flap in said exiting end of the carton.

* * * * *